US010566131B2

(12) United States Patent
Chin

(10) Patent No.: US 10,566,131 B2
(45) Date of Patent: Feb. 18, 2020

(54) TRANSFORMERS INCLUDING SECONDARY WINDING TURNS HAVING DIFFERENT DIAMETERS

(71) Applicant: Astec International Limited, Kwun Tong, Kowloon (HK)

(72) Inventor: Kwong Kei Chin, Fremont, CA (US)

(73) Assignee: Astec International Limited, Kwun Tong, Kowloon (HK)

( * ) Notice: Subject to any disclaimer, the term of this patent is extended or adjusted under 35 U.S.C. 154(b) by 109 days.

(21) Appl. No.: 15/910,777

(22) Filed: Mar. 2, 2018

(65) Prior Publication Data

US 2019/0272939 A1 Sep. 5, 2019

(51) Int. Cl.

| | |
|---|---|
| ***H01F 27/24*** | (2006.01) |
| ***H01F 27/28*** | (2006.01) |
| ***H01F 41/066*** | (2016.01) |
| ***H01F 27/32*** | (2006.01) |

(52) U.S. Cl.

CPC ..... *H01F 27/2823* (2013.01); *H01F 27/24* (2013.01); *H01F 27/2847* (2013.01); *H01F 27/32* (2013.01); *H01F 41/066* (2016.01)

(58) Field of Classification Search

CPC ..... H01F 5/00; H01F 27/00–36
USPC .... 336/65, 83, 108–184, 200, 220–223, 232
See application file for complete search history.

(56) References Cited

U.S. PATENT DOCUMENTS 5,084,958 A * 2/1992 Yerman ..... H01F 27/2804 29/602.1
5,684,445 A * 11/1997 Kobayashi ..... H01F 27/2866 336/206
6,204,745 B1 3/2001 Liu et al.
6,222,437 B1 * 4/2001 Soto ..... H01F 7/2847 336/200
6,522,233 B1 * 2/2003 Kyoso ..... H01F 27/306 336/192
7,479,863 B2 1/2009 Kit et al.
(Continued)

FOREIGN PATENT DOCUMENTS

JP 08097054 A * 4/1996

OTHER PUBLICATIONS

BT Coil Co., Ltd., http://www.btcoil.com/product.php?cid=62. 2002-2015 (2 pages).

(Continued)

*Primary Examiner* — Tuyen T Nguyen
(74) *Attorney, Agent, or Firm* — Harness, Dickey & Pierce, P.L.C.

(57) ABSTRACT

A transformer includes a transformer core, and a primary winding and a secondary winding each wound about the transformer core. The primary winding includes a wire wound in multiple primary winding layers, and each primary winding layer includes multiple primary turns arranged in a spiral. The secondary winding includes one or more substantially flat conductors defining multiple secondary winding layers. Each secondary winding layer includes one secondary turn, every two adjacent secondary turns have a single different one of the primary winding layers positioned between the two adjacent secondary turns to interleave the secondary winding and the primary winding, and each secondary turn has a different diameter than an adjacent one of the secondary turns.

23 Claims, 4 Drawing Sheets

(56) References Cited

U.S. PATENT DOCUMENTS

| | | | | |
|---|---|---|---|---|
| 7,511,599 | B2 * | 3/2009 | Ye | H01F 27/2852 336/200 |
| 7,982,576 | B2 | 7/2011 | Feng et al. | |
| 2010/0109831 | A1 | 5/2010 | Podevels et al. | |
| 2016/0225514 | A1 | 8/2016 | Cheng et al. | |

OTHER PUBLICATIONS

Dongguan Youhui Machinery Co., Ltd., Custom Wireless Charger Coil for Winding/Cooper Wire Inductor Coil, Guangdong, China.

* cited by examiner

TRANSFORMERS INCLUDING SECONDARY WINDING TURNS HAVING DIFFERENT DIAMETERS

FIELD

The present disclosure relates to transformers including secondary winding turns having different diameters.

BACKGROUND

This section provides background information related to the present disclosure which is not necessarily prior art.

Tight coupling between windings in a transformer is important for energy conversion efficiency. Transformers in AC-DC applications often have high turns ratios. For example, a higher voltage primary winding may have forty or more turns while a lower voltage secondary winding may have three or less turns. The secondary windings are often made of solid copper plate materials to handle high currents. In order to increase coupling, the primary winding is usually split into multiple layers, and the secondary plates are interleaved between the primary winding layers. However, interleaving the primary winding wires and the secondary winding plates complicates the transformer coil construction, which increases transformer size, reduces transformer electrical performance, etc.

SUMMARY

This section provides a general summary of the disclosure, and is not a comprehensive disclosure of its full scope or all of its features.

According to one aspect of the present disclosure, a transformer includes a transformer core, and a primary winding and a secondary winding each wound about the transformer core. The primary winding includes a wire wound in multiple primary winding layers, and each primary winding layer includes multiple primary turns arranged in a spiral. The secondary winding includes one or more substantially flat conductors defining multiple secondary winding layers. Each secondary winding layer includes one secondary turn, every two adjacent secondary turns have a single different one of the primary winding layers positioned between the two adjacent secondary turns to interleave the secondary winding and the primary winding, and each secondary turn has a different diameter than an adjacent one of the secondary turns.

According to another aspect of the present disclosure, a transformer includes a transformer core, and a primary winding and a secondary winding each wound about the transformer core. The primary winding includes a wire wound in multiple primary winding layers, and each primary winding layer includes multiple primary turns arranged in a spiral. The secondary winding includes a substantially flat conductor defining at least three secondary turns, every two adjacent secondary turns have a single different one of the primary winding layers positioned between the two adjacent secondary turns to interleave the secondary winding and the primary winding, and a transition portion between first and second ones of the secondary turns is offset from a transition portion between second and third ones of the secondary turns to avoid an overlap between the different transition portions.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Figure 1:
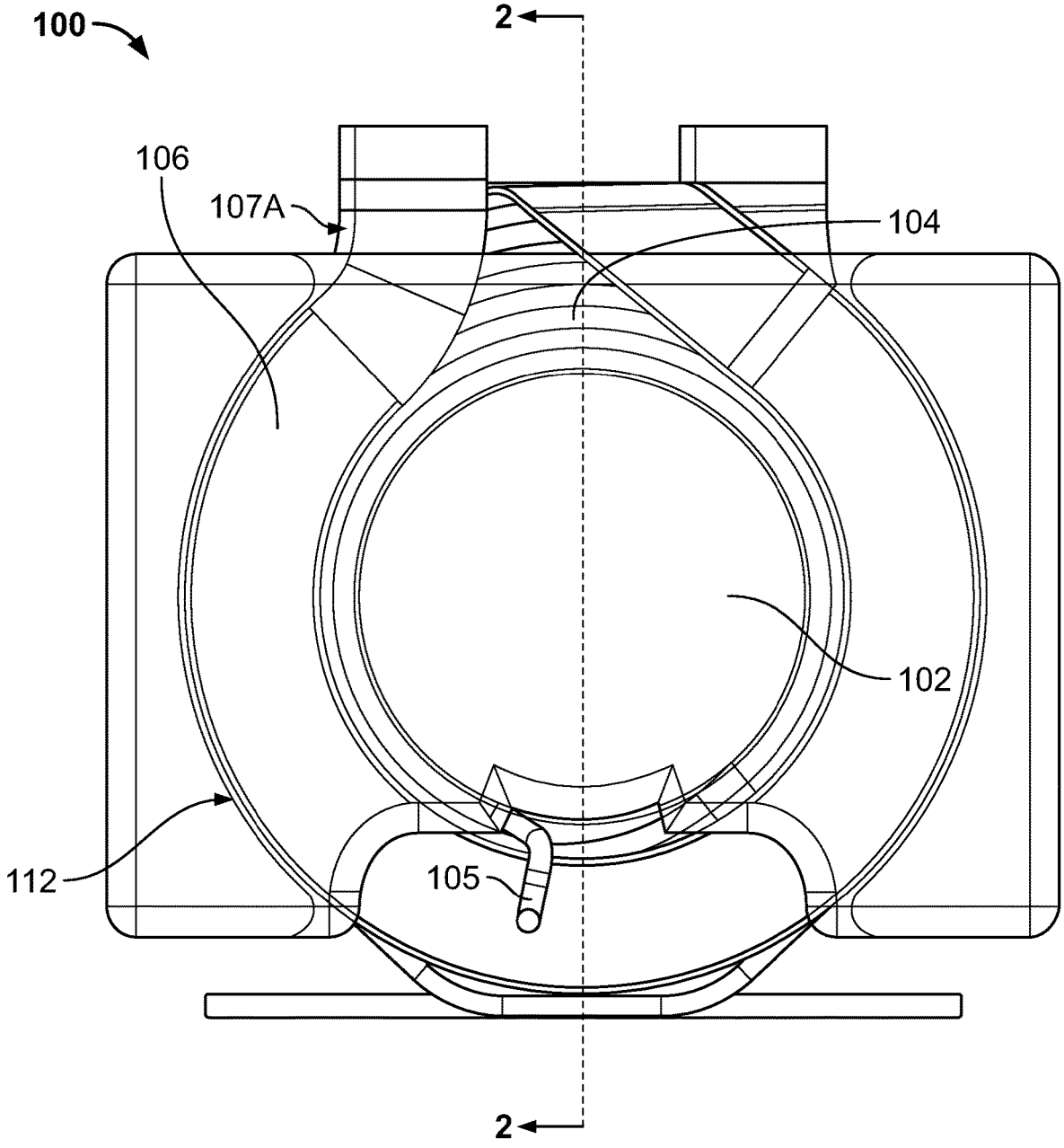
FIG. 1 is a front view of a transformer having secondary winding turns with different diameters, according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms.

These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
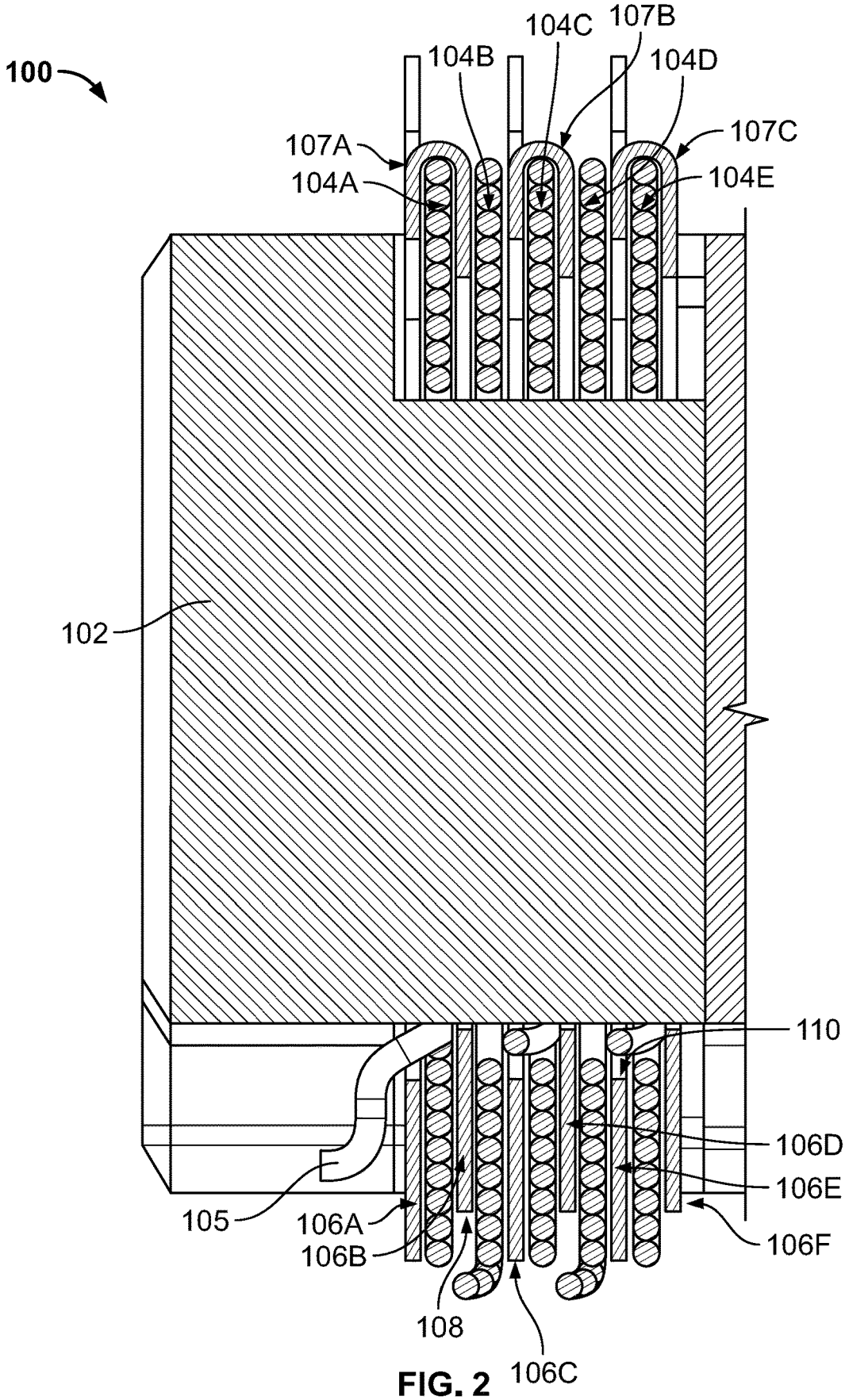
FIG. 2 is a section view taken along line 2-2 in FIG. 1.
Figure 3:
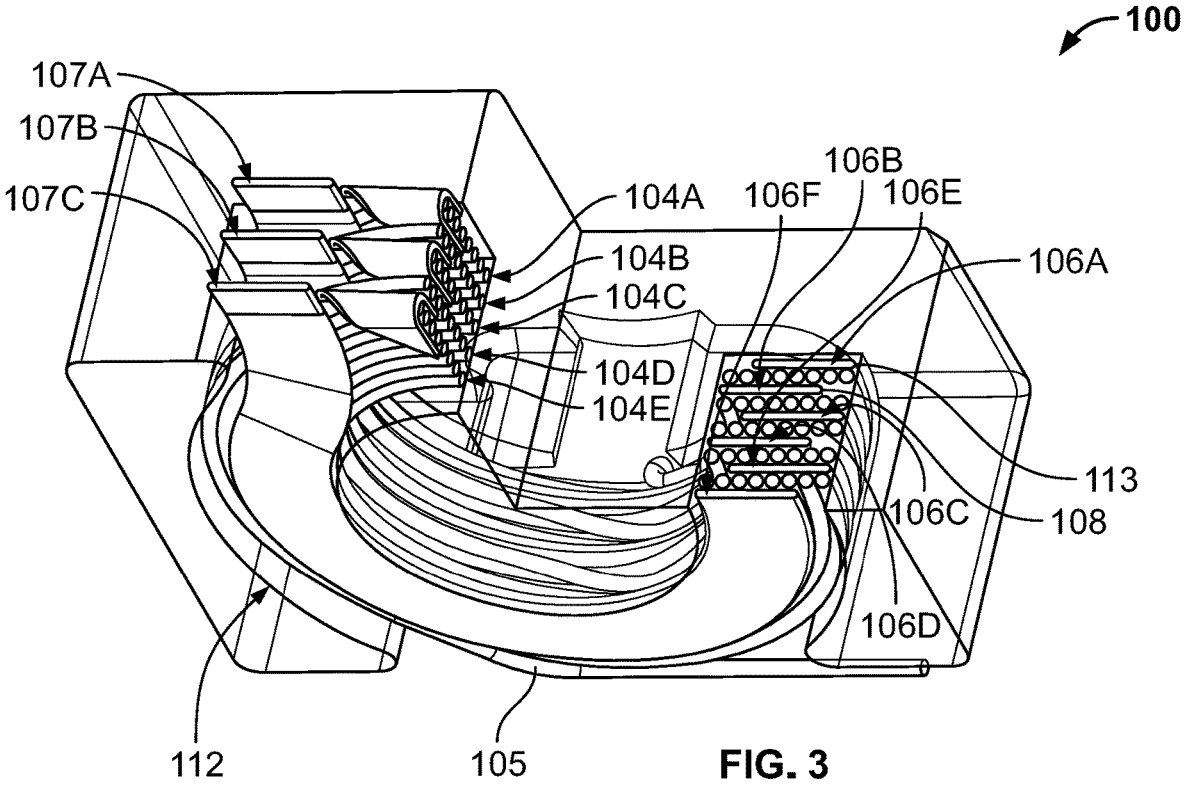
FIG. 3 is a cut away view of the transformer of FIG. 1.

A transformer according to one example embodiment of the present disclosure is illustrated in FIGS. 1-3 and indicated generally by reference number 100. The transformer 100 includes a transformer core 102, a primary winding 104 wound about the transformer core 102, and a secondary winding 106 wound about the transformer core 102.

The primary winding 104 includes a wire 105 wound in multiple primary winding layers 104A, 104B, 104C, 104D and 104E. Each primary winding layer 104A, 104B, 104C, 104D and 104E includes multiple primary turns arranged in a spiral.

The secondary winding 106 includes three substantially flat conductors 107A, 107B and 107C. The conductors 107A, 107B and 107C define multiple secondary layers, with each secondary layer including one secondary turn 106A, 106B, 106C, 106D, 106E and 106F.

Every two adjacent secondary turns have a single different one of the primary winding layers 104A, 104B, 104C, 104D and 104E positioned between the two adjacent secondary turns to interleave the secondary winding 106 and the primary winding 104. Each secondary turn has a different diameter than an adjacent one of the secondary turns. Specifically, secondary turns 106A, 106C and 106E have larger diameters than secondary turns 106B, 106D and 106F.

As shown in FIGS. 2 and 3, the wire 105 transitions between the primary winding layer 104A and the primary winding layer 102B at outermost turns of the primary winding layers 104A and 104B. In contrast, the wire 105 transitions between the primary winding layer 1046 and the primary winding layer 104C at innermost turns of the primary winding layers 104B and 104C. Therefore, the wire 105 alternates between transitioning from one primary winding layer to another at innermost turns of the spiral primary winding layers, and transitioning from one primary winding layer to another at outermost turns of the primary winding layers.

This configuration of the transformer 100 allows for tighter coupling between the primary winding 104 and the secondary winding 106. Specifically, because adjacent secondary turns 106A, 106B, 106C, 106D, 106E and 106F have different diameters, the wire 105 can transition between the primary winding layers 104A, 104B, 104C, 104D and 104E along alternating inner and outer portions of the secondary turns 106A, 106B, 106C, 106D, 106E and 106F.

For example, as illustrated in FIG. 2, the wire 105 transitions between the primary winding layer 102A and the primary winding layer 102B along an outer portion 108 of the secondary turn 106B. The wire 105 transitions between the primary winding layer 104B and the primary winding layer 104C along an inner portion 110 of the adjacent secondary turn 106C. Therefore, wire 105 alternates between transitioning from one primary winding layer to another along an inner portion of a secondary turn, and transitioning from one primary winding layer to another along an outer portion of a secondary turn.

Because the secondary turns have different diameters, different secondary turns may have diameters corresponding to different portions of the transformer 100. For example, the smaller diameter secondary turns 106B, 106D and 106F may have inner portion diameters that correspond to a diameter of the transformer core 102. Therefore, the inner portions of these smaller diameter secondary turns 106B, 106D and 106F can be positioned against the transformer core 102 to allow the wire 105 to pass over the outer portions 108 of the smaller diameter secondary turns 106B, 106D and 106F when the wire 105 transitions between primary winding layers.

In contrast, the larger diameter secondary turns 106A, 106C, and 106E may have outer portion diameters that correspond to a diameter of a core window 112. Therefore, the outer portions 113 of these larger diameter secondary turns 106A, 106C, and 106E can be positioned against the core window 112 of the transformer 100 to allow the wire 105 to pass over the inner portions 110 of the larger diameter secondary turns 106A, 106C, and 106E when the wire 105 transitions between primary winding layers.

For example, the wire 105 can pass through a space defined between the transformer core 102 and an inner portion 110 of the larger diameter secondary turns 106A, 106C, and 106E, and the wire 105 can pass through a space defined between the core window 112 and the outer portion 108 of the smaller diameter secondary turns 106B, 106D and 106F.

This transformer configuration allows the wire 105 to spiral inward at a first primary winding layer, then transition to a second primary winding layer at an innermost turn of the spiral. Next, the wire 105 spirals outward in the second primary winding layer until it reaches an outermost turn of the spiral, at which point the wire transitions to a third primary winding layer and begins spiraling inward again.

The transition scheme of the transformer 100 allows for close sandwiching of the secondary winding turns between each primary winding layer, because no connection wire is trapped in the middle of a primary-secondary interface. The connections between primary winding layers can be short and direct, which reduces undesirable parasitics.

FIGS. 2 and 3 illustrate the secondary winding 106 as including three substantially flat conductors 107A, 107B and 107C arranged in parallel. Each conductor 107A, 107B and 107C includes two turns. In other embodiments, the secondary winding 106 may include more or less conductors, each conductor may include more or less turns, etc.

The primary winding 104 includes five primary winding layers 104A, 104B, 104C, 104D and 104E. Each primary winding layer 104A, 104B, 104C, 104D and 104E includes eight turns. Specifically, each primary winding layer 104A, 104B, 104C, 104D and 104E includes eight turns arranged in a spiral pattern. In other embodiments, the primary winding 104 may include more or less primary winding layers (e.g., at least three primary winding layers), more or less turns per primary winding layer (e.g., at least four turns per primary winding layer), etc.

In the transformer 100 illustrated in FIGS. 2 and 3, the turns ratio of the number of primary winding turns to the number of secondary winding turns is forty to two. For example, there may be about 380V across the primary winding 104 while there is about 12V across the secondary winding 106. Therefore, the primary winding 104 can be a high voltage primary winding, while the secondary winding 106 is a low voltage secondary winding that conducts a high secondary current.

In other embodiments, the turns ratio may be less than or greater than forty to two. For example, the turns ratio may be at least five to one, etc. In the case of a five to one turns ratio, there may be about 100V across the primary winding 104 while there is about 12V across the secondary winding 106.

The wire 105 may be a continuous wire that defines the multiple primary winding layers 104A, 104B, 104C, 104D and 104E. For example, a single continuous length of wire may be wound in a spiral pattern to define eight turns in each primary winding layer 104A, 104B, 104C, 104D and 104E, as well as the transitions between the primary winding layers 104A, 104B, 104C, 104D and 104E. In some embodiments, the wire 105 may include an insulation coating to inhibit an electrical short between the primary winding 104 and the secondary winding 106.

Figure 4:
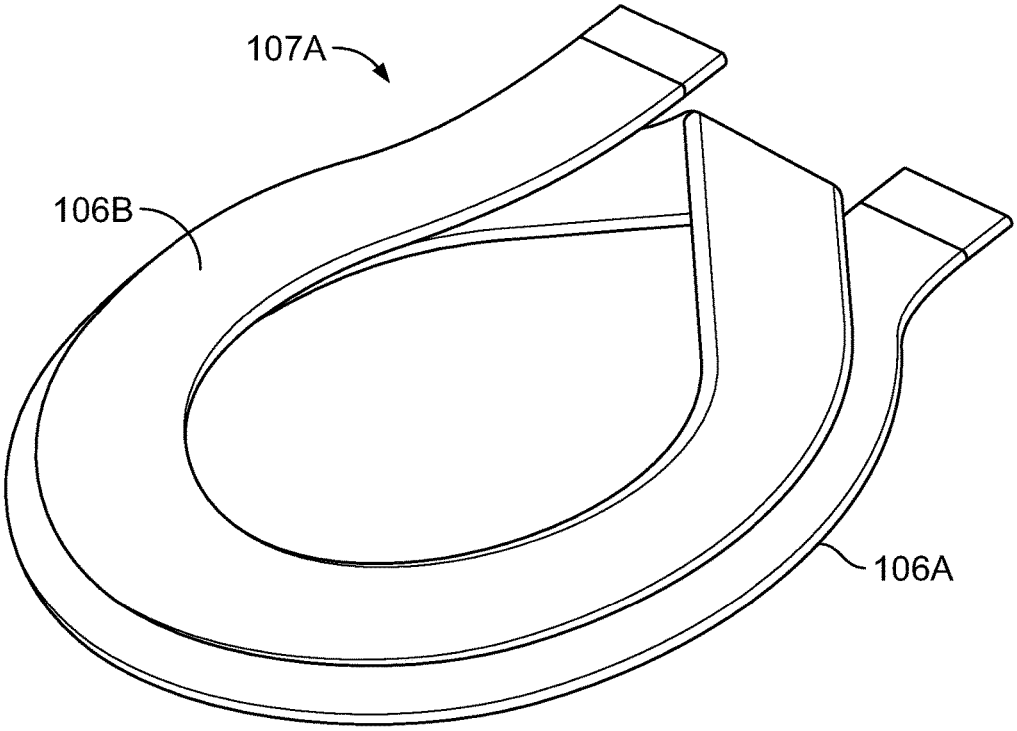
FIG. 4 is an isometric view of one secondary winding conductor of the transformer of FIG. 1.

The substantially flat conductors 107A, 107B and 107C of the secondary winding 106 may be continuous substantially flat conductors that define multiple secondary turns. For example, as shown in FIG. 4, the conductor 107A is a continuous conductor that defines the two secondary turns 106A and 106B of the secondary winding 106. The two adjacent secondary turns 106A and 106B have different diameters. Specifically, the secondary turn 106A has a larger diameter than the secondary turn 106B.

The conductor 107A is substantially flat because the conductor 107A includes a transition portion 114 between the secondary turns 106A and 106B. Specifically, the transition portion 114 is an approximately 180 degree bend in the conductor 107A. The conductor 107A is bent at the transition portion 114 in a manner that allows for current to conduct between the secondary turn 106A and the secondary turn 106B.

The conductor 107A may include any suitable material. For example, the conductor 107A may be a solid copper plate. This allows the conductor 107A to conduct a high secondary current (e.g., a higher current than the primary wire 105 is capable of conducting safely). In some embodiments, the conductor 107A may include an enamel insulation coating (and/or other suitable insulation coating) to inhibit an electrical short between the conductor 107A and the wire 105 of the primary winding.

In some embodiments, the conductor 107A may be formed from a single piece of pre-coated flat conductor material, in contrast to stamping sheet copper. Stamping can be a wasteful process that cuts away unwanted copper to form a shape, and can leave sharp cut edges. These sharp edges may require extra insulation and cushioning to be applied to the edges to inhibit the conductor 107A from cutting into insulation of high voltage primary winding wires. Forming the conductor 107A from a single piece of pre-coated flat conductor material can avoid sharp edges created by a stamping process, and can reduce the need for extra insulation and cushioning. The conductor 107A may be pre-coated by applying an enamel coating prior to bending the conductor 107A, after bending the conductor 107A, etc.

The transformer 100 may be used in any suitable application. For example, a power supply (e.g., a switched-mode power supply, etc.) may include the transformer 100. The power supply could be an AC-DC converter, and may be rated for 750 W, 1000 W, 1500 W, etc.

Figure 5:
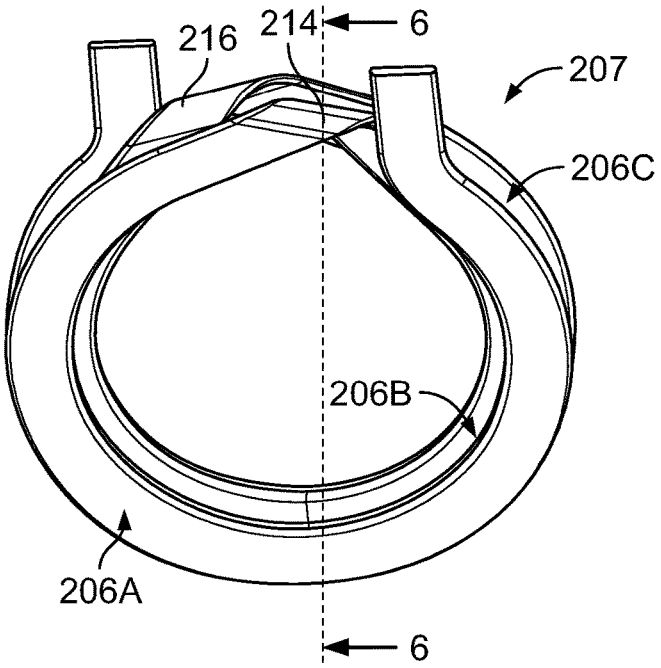
FIG. 5 is a front view of a secondary winding conductor having three turns, according to another example embodiment of the present disclosure.
Figure 6:
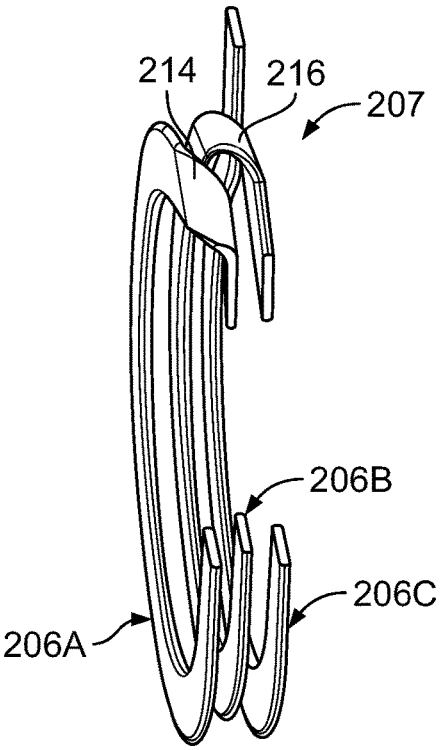
FIG. 6 is a section view taken along line 6-6 in FIG. 5.

FIGS. 5 and 6 illustrate a conductor 207 according to another example embodiment of the present disclosure. As shown in FIGS. 5 and 6, the conductor 207 includes three secondary turns 206A, 206B and 206C. Adjacent secondary turns 206A, 206B and 206C have different diameters. Specifically, the secondary turn 206B has a smaller diameter than the secondary turns 206A and 206C.

The conductor 207 includes a transition portion 214 between the secondary turn 206A and the secondary turn 206B. The conductor 207 also includes a transition portion 216 between the secondary turn 206B and the secondary turn 206C. The transition portions 214 and 216 may be defined by bends in the conductor 207.

As shown in FIGS. 5 and 6, the transition portions 214 and 216 are offset from one another. Therefore, the transition portions 214 and 216 do not overlap with one another (e.g., the transition portions 214 and 216 are rotated clockwise or counter-clockwise from one another when viewed from a front or back of the conductor 207). Because the transition portions 214 and 216 are offset, the secondary turns 206A, 206B and 206C may be spaced closer together, which can increase electrical coupling between the secondary turns 206A, 206B and 206C and any primary windings positioned between the secondary turns 206A, 206B and 206C.

If the transition portions 214 and 216 were to overlap one another, the overlapped portions could separate the primary windings positioned between the secondary turns 206A, 206B and 206C further apart. In that case, the electromagnetic coupling between the primary and secondary windings would be reduced, thereby reducing energy efficiency.

The conductor 207 may be used in a transformer similar to the transformer 100 discussed above relative to FIGS. 1-3. For example, every two adjacent secondary turns of the conductor 207 may have a single different primary winding layer positioned between the two adjacent secondary turns, to interleave the conductor 207 with a primary winding.

Figure 7:
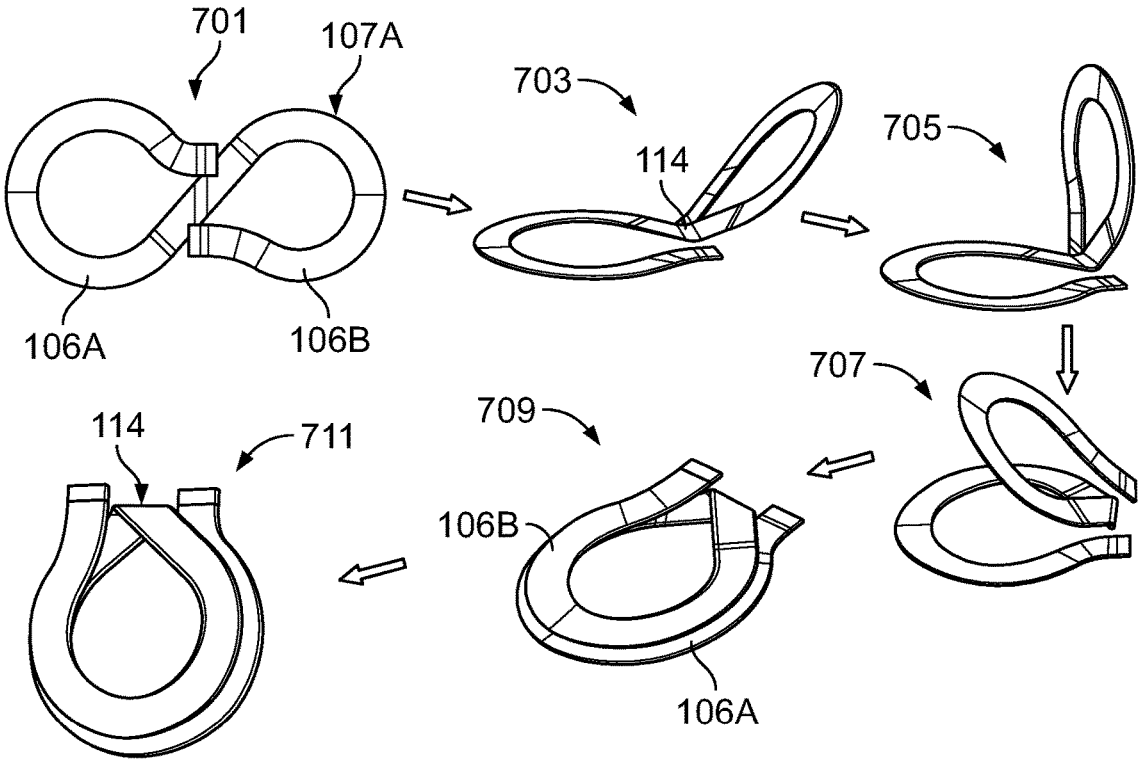
FIG. 7 is a diagram of a process of forming a secondary winding conductor for a transformer, according to yet another example embodiment of the present disclosure.

FIG. 7 illustrates a process for forming the conductor 107A illustrated in FIG. 4. A similar process may be used to form the conductor 207 illustrated in FIGS. 5 and 6, but could require two bending steps instead of one. As shown in FIG. 7, the conductor 107A starts out in a figure eight configuration at 701. The turns 106A and 106B of the figure eight configuration have different diameters.

At 703, 705 and 707, the conductor 107A is bent along the transition portion 114 of the conductor 107A. Specifically, the transition portion 114 of the conductor 107A is bent approximately 180 degrees so the turns 106A and 106B oppose each other.

The finished conductor 107A is illustrated at 709 and 711, which shows the turns 106A and 106B having different diameters. The transition portion 114 is a bend in the conductor 107A. In some embodiments, the transition portion 114 may be slanted at an angle, so that the transition portion 114 is not parallel with top edges of ends of the conductor 107A. A slanted transition portion 114 (e.g., a slanged bend edge) can physically enable formation of a multi-turn conductor using a single strip of coated material (e.g., flat wire).

Example embodiments described herein may provide one or more (or none) of the following advantages: increased energy efficiency and reduced thermal load due to power loss reduction from improved winding interleaving, high voltage isolation due to reduction of high potential failure, etc.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A transformer comprising:

a transformer core;

a primary winding wound about the transformer core, the primary winding including a wire wound in multiple primary winding layers, and each primary winding layer including multiple primary turns arranged in a spiral; and a secondary winding wound about the transformer core, the secondary winding including one or more substantially flat conductors defining multiple secondary winding layers, each secondary winding layer including one secondary turn, every two adjacent secondary turns having a single different one of the primary winding layers positioned between the two adjacent secondary turns to interleave the secondary winding and the primary winding, and each secondary turn having a different diameter than an adjacent one of the secondary turns.

2. The transformer of claim 1, wherein:

the wire is arranged to transition between a first and a second of the multiple primary winding layers at innermost turns of the first and second primary winding layers; and the wire is arranged to transition between the second and a third of the multiple primary winding layers at outermost turns of the second and third primary winding layers.

3. The transformer of claim 2, wherein:

the wire is arranged to transition between the first and second primary winding layers along an inner portion of a first one of the secondary turns;

the wire is arranged to transition between the second and third primary winding layers along an outer portion of a second one of the secondary turns; and the first and second ones of the secondary turns are adjacent one another.

4. The transformer of claim 3, wherein:

a diameter of the outer portion of the first one of the secondary turns corresponds to a diameter of a core window of the transformer; and a diameter of the inner portion of the second one of the secondary turns corresponds to a diameter of the transformer core.

5. The transformer of claim 1, wherein the one or more substantially flat conductors of the secondary winding include at least three substantially flat conductors arranged in parallel.

6. The transformer of claim 1, wherein each substantially flat conductor includes at least two turns.

7. The transformer of claim 1, wherein the multiple primary winding layers include at least three primary winding layers.

8. The transformer of claim 1, wherein each primary winding layer includes at least four primary turns.

9. The transformer of claim 1, wherein a ratio of the number of primary turns to the number of secondary turns is at least five to one.

10. The transformer of claim 1, wherein the wire comprises a continuous wire defining the multiple primary winding layers.

11. The transformer of claim 1, wherein the substantially flat conductor includes a continuous substantially flat conductor defining multiple ones of the secondary turns.

12. The transformer of claim 1, wherein the substantially flat conductor includes an enamel insulation coating.

13. The transformer of claim 1, wherein each substantially flat conductor comprises a single piece of pre-coated flat conductor material.

14. A transformer comprising:

a transformer core;

a primary winding wound about the transformer core, the primary winding including a wire wound in multiple primary winding layers, and each primary winding layer including multiple primary turns arranged in a spiral; and a secondary winding wound about the transformer core, the secondary winding including a substantially flat conductor defining at least three secondary turns, every two adjacent secondary turns having a single different one of the primary winding layers positioned between the two adjacent secondary turns to interleave the secondary winding and the primary winding, and a transition portion between first and second ones of the secondary turns offset from a transition portion between second and third ones of the secondary turns to avoid an overlap between the transition portions.

15. The transformer of claim 14, wherein each transition portion includes a bend in the substantially flat conductor.

16. The transformer of claim 14, wherein adjacent ones of the at least three secondary turns have different diameters.

17. The transformer of claim 14, wherein:

the wire transitions between a first and a second of the multiple primary winding layers at innermost turns of the first and second primary winding layers; and the wire transitions between the second and a third of the multiple primary winding layers at outermost turns of the second and third primary winding layers.

18. The transformer of claim 17, wherein:

the wire transitions between the first and second primary winding layers along an inner portion of a first one of the secondary turns;

the wire transitions between the second and third primary winding layers along an outer portion of a second one of the secondary turns; and the first and second ones of the secondary turns are adjacent one another.

19. The transformer of any one of claim 14, wherein the substantially flat conductor includes a continuous substantially flat conductor defining the at least three secondary turns.

20. The transformer of claim 1, wherein the substantially flat conductor comprises a single piece of pre-coated flat conductor material.

21. The transformer of claim 18, wherein:

a diameter of the outer portion of the first one of the secondary turns corresponds to a diameter of a core window of the transformer; and a diameter of the inner portion of the second one of the secondary turns corresponds to a diameter of the transformer core.

22. The transformer of claim 1, wherein the wire includes an insulation coating.

23. The transformer of claim 14, wherein the substantially flat conductor includes an enamel insulation coating.

* * * * *